United States Patent [19]

Boudreaux

[11] Patent Number: 4,464,127

[45] Date of Patent: Aug. 7, 1984

[54] SHAFT IMMOBILIZER APPARATUS

[76] Inventor: Mark J. Boudreaux, P.O. Box 376, Chauvin, La. 70344

[21] Appl. No.: 366,550

[22] Filed: Apr. 8, 1982

[51] Int. Cl.[3] ..... B63H 23/00

[52] U.S. Cl. ..... 440/74; 188/75

[58] Field of Search ..... 188/75, 1.11, 262, 250 A, 188/265; 440/74

[56] References Cited

U.S. PATENT DOCUMENTS

| | | | |
|---|---|---|---|
| 474,169 | 5/1892 | Hellinger | 440/74 |
| 678,228 | 7/1901 | Cormier | 440/74 |
| 1,778,570 | 10/1930 | Soresi | 188/75 |
| 2,055,267 | 9/1936 | Uffert | 188/75 |
| 2,251,615 | 8/1941 | Miehle | 188/1.11 |
| 3,036,667 | 5/1962 | Schilling | 188/75 |
| 3,731,768 | 5/1973 | Fetzer | 188/75 |
| 4,031,987 | 6/1977 | Webb | 188/75 |
| 4,145,940 | 3/1979 | Woloveke et al. | 188/75 |

*Primary Examiner*—Trygve M. Blix
*Assistant Examiner*—Patrick W. Young
*Attorney, Agent, or Firm*—Bode & Smith

[57] ABSTRACT

A propeller shaft immobilizer having a substantially hollow, open ended rectangular lower base portion fixedly mounted to the floor portion of a boat. An upper support base portion is slidably mounted on the lower base portion to allow vertical movement of the upper base portion. Upper and lower engaging surfaces are movably mounted on the upper base portion and movable by hydraulic power to frictionally engage the propeller shaft to be immobilized.

4 Claims, 4 Drawing Figures

SHAFT IMMOBILIZER APPARATUS

BACKGROUND OF THE INVENTION

1. Field of the Invention

The present invention relates to immobilizers for propeller shafts and the like. Even more particularly, the present invention relates to a propeller shaft immobilizer apparatus which hydraulically or manually immobilizes the propeller shaft when the engine propelling the shaft becomes inoperative.

2. General Background

In the use of large boats, particularly in crew boats, in servicing the offshore oil and gas industry, most of the types of craft utilized are multi-engined, in order to effectively propel the craft through the often turbulent offshore waters. It may often occur while such a craft is out to sea, that one or more of the engines in the craft may fail, and the engine, therefore, becomes inoperative. However, the propeller beneath the craft, which is operated by the engine, remains exposed to the flow of current since the craft continues to be propelled by the remaining engines. The screw-typed propeller, because of its vaned construction, continues to turn, and rotating the shaft connected thereto.

In most engine constructions of this type of craft, at the failure of the engine, a clutch mechanism re-engages the propeller shaft shince the engine is inoperative. It is only when the engine is in the operative mode that the clutch mechanism would not be in contact with the shaft, and the shaft would be allowed to rotate freely in conjunction with the operation of the engine. However, in the case of an inoperative engine, with the clutch mechanism in frictional contact with the propeller shaft, the propeller shaft will rotate freely, due to the force of the current of water through the vaned propeller, and in doing so, may cause damage to the clutch mechanism. Over a long period of time, in such cases where the crew boat is on an extended trip through the offshore waters, the damage to the clutch mechanism can be such that the clutch mechanism has to be replaced at a tremendous cost, the replacement being due solely to the fact that the rotation of the shaft against the clutch mechanism resulted in the irreparable damage to the mechanism which should be replaced.

In the present state of the art, often times crews on the crew boat, may attempt to alleviate the rotation of the shaft by several haphazard approaches. One approach would simply be to engage a linked chain around the shaft and secure the ends of the chain to the sides of the boat, so that should the shaft attempt to rotate freely in the water, the engagement of the links against the shaft may serve to prevent its rotation. However, it has been shown that this type of stopgap measure is for the most part ineffective, and when the shaft does rotate, the links of the chain in contact with the shaft simply serve to do severe damage to the shaft, and the result is the replacement not only of the clutch mechanism but of the shaft itself.

Another stopgap measure would simply be to secure a very large pipe wrench to the shaft, so that the rotation of the shaft in a certain direction would cause the pipe wrench to engage the shaft, and the handle of the pipe wrench would be so situated that the pipe wrench could not rotate, and rotation of the shaft would be prevented. However, should the shaft rotate in the opposite direction, even so slightly, the pipe wrench would, because of its construction, be dislodged from the shaft and then the shaft would be allowed to be rotating freely as with no stop measure at all.

Several patents have been secured which address the problem of a freely rotating shaft or the like, the most pertinent being as follows:

U.S. Pat. No. 3,831,547 issued to Bird entitled "Propeller Shaft Lock" would teach the use of a shaft lock for preventing rotation of a boat propeller in controlling its position when the engine is off. It has a cam mounted on the propeller shaft and a stop member which is movable into and away from the path of rotation of the shoulder member.

U.S. Pat. No. 3,786,775 issued to Sarns entitled "Shaft Lock" teaches the use of a shaft lock for auxiliary sailboats with a split flanged-collar clampable to a rotable shaft having a pair of opposed recesses. There is provided a pivotally mounted latch member adjacent a flanged collar for cooperating with the recesses in holding the shaft in certain positions. There is further provided a lever member connected to the latch member for selectively moving the latch in cooperative engagement with the recess.

U.S. Pat. No. 697,053 issued to G. Whittlesey entitled "Brake for Propeller Shafts" would teach the use of a system of mechanisms whereby the action of the engine and the propeller may be controlled and made more uniform under the varying conditions of the sea in order to avoid the many of the dangers arising from the inadequate control of the engine and moving parts.

U.S. Pat. No. 605,545 issued to Guerrant entitled "Friction Lessening Device and Brake for Propeller Shafts" would teach of a device for lessening the end thrust friction and the bearings of a screw propeller shaft of steam vessels and a brake operating upon the propeller shaft applied by reason of the increased momentum of the shaft occasioned by the propeller screw being thrown from the water upon the rising of the stern of the vessel in turbulent water.

U.S. Pat. No. 474,169 issued to A. Hellinger entitled "Regulating Propellers of Vessels" relates to means and devices for regulating the speed of revolution of the screw shaft to propellers under the varying conditions under which the boat may have to work due to rough seas or the like. Basically, it would regulate the amount of motor fluids applied to the screw engine and applying a brake to the screw shaft, both of which are operated by means of the devices for regulating the propeller momentum.

U.S. Pat. No. 278,182 issued to G. H. Reynolds entitled "Auxiliary Steam Power for Sailing Vessels" relates to the enabling of auxiliary propulsion to be applied without in the least interfering with the working of the fore and aft of the sails of the boat. The device would act on the propeller shaft for locking the propeller in such position that its blades would be maintained in a position behind the stern post when it is desirable to proceed under sail alone.

GENERAL DISCUSSION OF THE PRESENT INVENTION

The present invention would solve the problems and shortcomings in the present state of the art in a simple and inexpensive straightforward manner. The present invention provides for a propeller shaft immobilizer wherein there is vertically disposed lower base section mounted fixedly to the floor portion of a boat. There is further provided an upper support base portion which is slidably mounted onto the lower base portion, with the ability to move upward and downward. There is also a lower and upper engaging means, mounted on the upper base portion which are movable to frictionally engage the propeller to be immobilized, with the lower and upper engaging means movement being provided by hydraulic power or the like, which would be provided through a hydraulic source. There would be further provided a means to maintain the upper and lower engaging means in contact with the propeller as desired, so that the propeller does not rotate when not in use.

Thus, it is an object of the present invention to provide a simple and straightforward apparatus for immobilizing a propeller of a crew boat or the like when the propeller is not in use.

It is another object of the present invention to provide an apparatus for immobilizing the propeller of a boat, so that the internal workings of the engine and clutch are not damaged due to the free rotation of the propeller shaft.

It is yet another object of the present invention to provide an apparatus for immobilizing the propeller shaft when the propeller is not in operation which is hydraulically controlled and can be maintained in the immobilized state for as long as necessary.

It is still a further object of the present invention to provide an apparatus which may be easily installed in a boat and easily removed when the propeller shaft has to undergo maintenance during the life of the boat.

In order the accomplish the various objects of the present invention, it is a feature of the present invention to provide a propeller shaft immobilizer apparatus having upper and lower surfaces for frictionally engaging the propeller shaft and immobilizing its free rotation during non-use.

It is further feature of the present invention to provide an apparatus for immobilizing propeller shafts having an upper and lower engaging surfaces which engage the propeller shaft through the use of hydraulic cylinders and maintained in position through hydraulic pressure.

It is yet another feature of the apparatus of the present invention to provide a means for slidably removing the engaging portion of the apparatus allowing easy access to the propeller shaft for maintenance work on the shaft.

BRIEF DESCRIPTION OF THE DRAWINGS

For a further understanding of the nature and object of the present invention, reference should be had to the following detailed description taken in conjunction with the accompanying drawings, in which like parts are given like reference numerals and, wherein.

DETAILED DESCRIPTION OF THE PREFERRED EMBODIMENT

Figure 1:
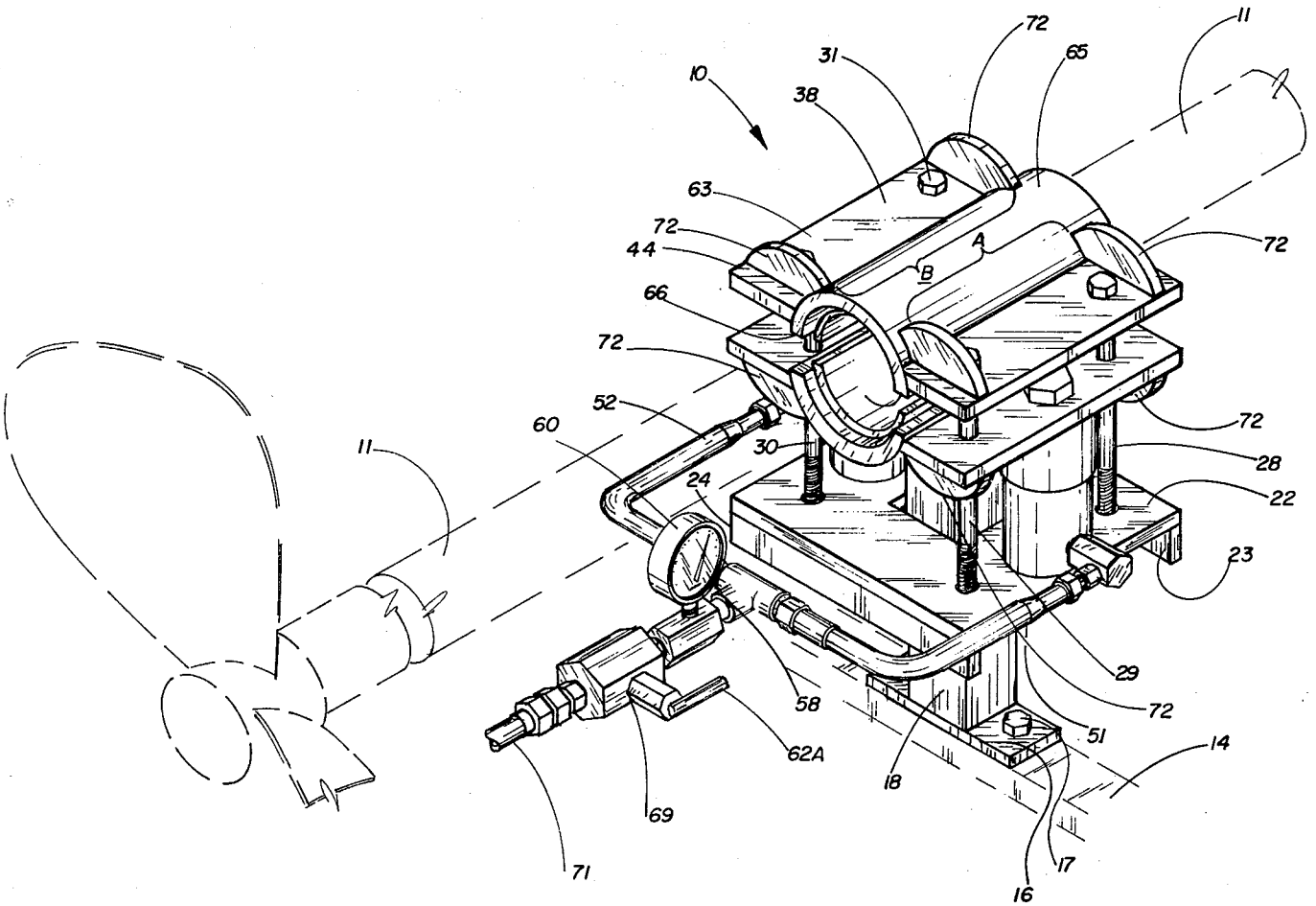
FIG. 1 is an overall prospective view of the preferred embodiment of the apparatus of the present invention.

FIG. 1 best illustrates the preferred embodiment of the apparatus of the present invention designated generally by the numeral 10. In FIG. 1 there is illustrated propeller shaft immobilizer apparatus 10 mounted to the bottom portion of a crew boat or the like by boltingly attaching apparatus 10 onto transverse beam 14, with beam 14 stretching between a pair of longitudinally placed support beams running the length of the boat. Apparatus 10 would be mounted onto beam 14 via mounting plate 16 through the attachment of bolts 17 on each end of plate 16 to insure a secure and firm mounting of the apparatus. Intergrally attached to plate 16 is a lower base support section 18 which is substantially rectangular in nature and comprises a four walled open-ended structure, as is better illustrated in side view in FIG. 2, the open-ended structure defining a support base for receiving the main portion of the immobilizer apparatus 10, as will be discussed further.

Figures 2, 3, 4:
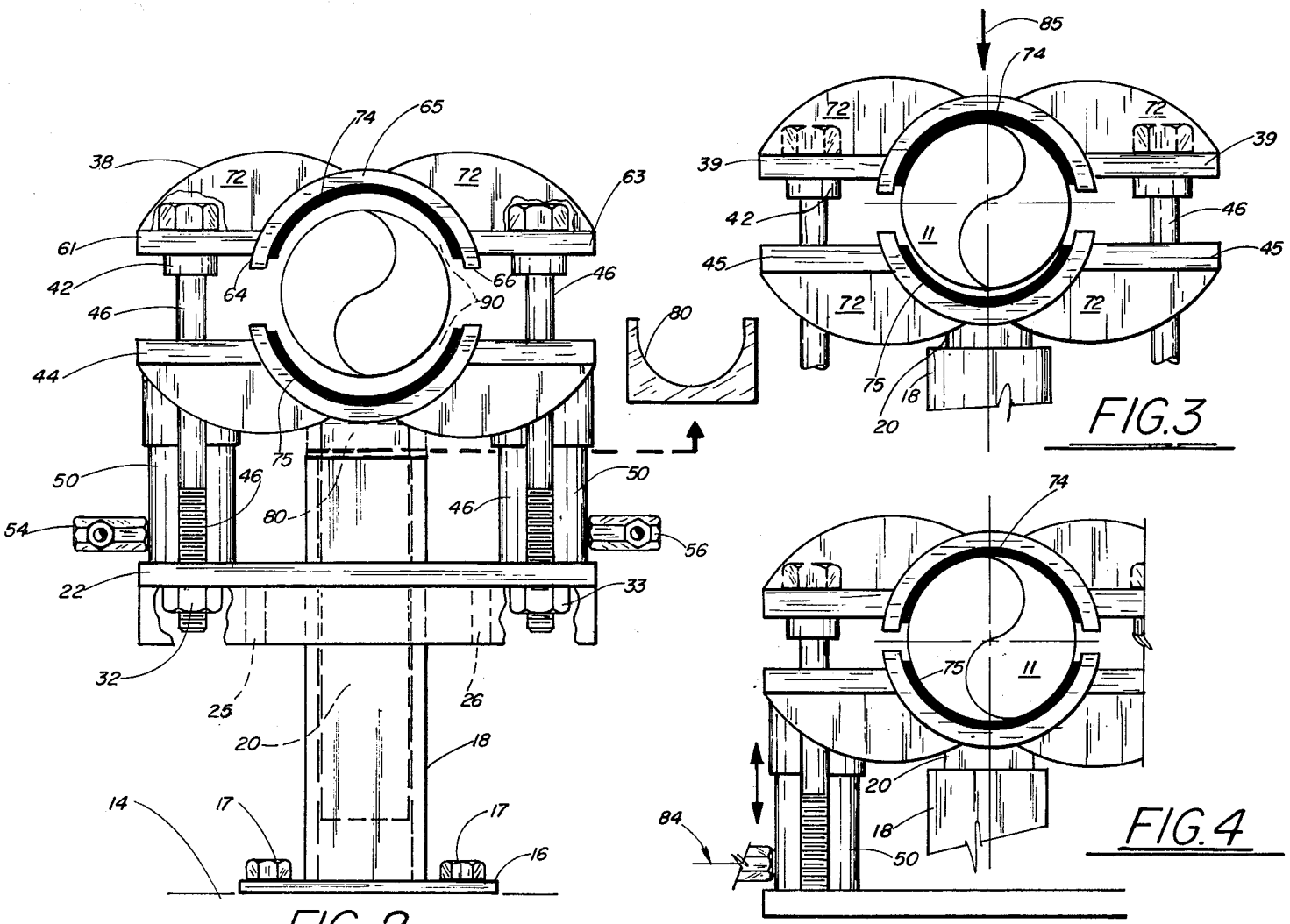
FIG. 2 is a side view of the preferred embodiment of the apparatus of the present invention illustrating the engaging portions of the invention in the open position.
FIGS. 3 and 4 are representational side views of the preferred embodiment of the apparatus of the present invention illustrating in FIG. 3 the engaging means in a partial closed state, and in FIG. 4 the engaging means in the fully closed state around the propeller shaft.

Further illustrated in FIG. 2, in phanthom view is upper support portion 20 which is likewise, a rectangular support leg portion, which is slidably mounted into the opening of lower support base portion 18, and has secured on its upper end the remainder major portion of apparatus 10. Therefore, the major engaging portion of apparatus 10 has the capability of being slidably removed from base 18 by simply slidably removing upper base post 20 out of the opening in base support 18, should apparatus 10 be wished to be removed from position when not in use.

Apparatus 10 further provides floor portion 22 which is approximately ¼ inch to ½ inch thickness steel or the like, which is reinforced by a pair of end vertically disposed wall portions 23 and 24, which are rigidly connected by welding or the like to the lower surface of floor portion 22 in order to reinforce the support ability of floor portion 22. There is further provided transverse wall portions 25 and 26, which are illustrated in phantom in FIG. 2, (but cannot be viewed in FIG. 1) which, like wall portions 23 and 24, serve to reinforce the strength of floor portion 22.

Floor portion 22 has threaded therethrough a plurality of bolts 28, 29, 30 and 31, which are threadably engaged through the surface of the floor portion 22, substantially at each corner of floor portion 22, in order to provide a support for the upper and lower engaging units as will be described further. Bolts 28 through 31, are secured on their lower most end via lock nuts 32 through 35, (with only nuts 32 and 33 visable in the drawings).

Bolts 28 through 31 extend upward a distance and provide support for upper engaging section 38, which is fixedly engaged between the head of bolts 28 through 31 on the upper floor surface of upper engaging means 38, and collars 42 located directly beneath the lower surface of upper engaging portion 38, and fastened securely to the body of bolts 28 through 31, via allen nuts to provide stable support area at each corner of upper engaging portion 38, which is substantially the same width and length as floor portion 22.

Situated between floor portion 22, and upper engaging means 38, there is further provided lower engaging means 44, which is substantially the same width and length as lower portion 22 and upper engaging portion 38, and slidably moves along the posts in body portion 46 of each bolt 28 through 31 respectively, so that lower engaging portion 44 is allowed to move freely up and down the length of body portion 46 of bolts 28 through 31 during operation of apparatus 10.

In order to provide movement up and down of lower engaging portion 44, there is vertically disposed between lower floor support portion 22 and lower engaging section 44, a pair of spring-loaded hydraulic cylinders 50 which are securely mounted on their lower end to lower floor portion 22, and at their upper end to lower engaging section 44. The lower engaging portion 44, therefore, moves in relation to the expansion or contraction of cylinders 50 during the addition of reduction of hydraulic fluid into cylinders 50. Hydraulic cylinders 50 are typically spring-loaded cylinders, so that when not hydraulically expanded, the inner springs contract each cylinder 50 to its non-operative state.

In construction, upper engaging section 38, and lower engaging section 44, are substantially mirror images of one another, and in detailed description upper engaging section 38 will be utilized as the example in explaining the construction of the sections. In actuality, each engaging section, both upper and lower 38 and 44 respectively, are comprised of three major sections. There is provided a left horizontally disposed floor portion 61 and a right horizontally disposed floor portion 63, each of which are intergrally connected via welding or the like along their lengths at points A and B respectively to a central semi-circular mid-section 65 which would substantially conform to the outer circumference of propeller shaft 11 to be immobilized, with the upper most semi-circular section 65 conforming to the upper half of the propeller shaft, and the lower most portion of lower engaging section 44 conforming to the lower half circumference of the propeller shaft, when both in the immobilized state, i.e. in friction contact with the propeller shaft, would define circular engaging means around the propeller shaft, thus providing total immobilization of the shaft as will be discussed further. (See FIG. 4)

As is seen in FIGS. 1 and 2, left and right floor portions 61 and 63 are attached to mid-portion 65 at points A and B somewhat above the leading ends 64 and 66 of portions 61 and 63 respectively, so that there is assured a complete coupling of engaging sections 38 and 44 around the exterior of shaft 11.

There are further provided on the upper surface of upper engaging means 38 and lower engaging means 44, a plurality of gusset plates 72, vertically and transversely disposed, in order to provide additional structural strength to upper and lower engaging means 38 and 44 and prevent warping of the engaging means.

The inner surface of sections 65 are provided with a layer of typical brake lining 74, adhered to sections 65 through riveting or the like, to provide strong frictional engagement between engaging means 38 and 44 and shaft 11.

Further illustrated in FIG. 1, are hydraulic lines 51 and 52, which connect into hydraulic fluid connectors 54 and 56 respectively (as seen in FIG. 2) for feeding hydraulic fluid into hydraulic cylinders 50 during operation. Hydraulic lines 51 and 52 merged into common hydraulic line 58, which would be threadably engaged to a read-out means 60 for identifying the amount of hydraulic pressure in the system, and further engage to closure valve 69 for either relieving the hydraulic fluid from the system, or for maintaining the pressure in the hydraulic fluid during the immobilization process. The hydraulic fluid, of course, would be obtained through a typical hydraulic source, such as a pump or the like via line 71.

FIGS. 2 through 4, and particularly FIGS. 3 and 4, illustrate the sequence of steps that take place during the operation of apparatus 10, during the immobilization of propeller shaft 11. Prior to the discussion of the operation of apparatus 10, it may be prudent to discuss the manner in which apparatus 10 is mounted onto the bottom of a crew boat or the like via transverse beam 14.

Prior to the placement of transverse beam 14 in position, apparatus 10 would be placed onto propeller shaft 11, by removal of nuts 32 through 35 from bolts 28 through 31 respectively. This would allow the removal of upper engaging section 38 from the apparatus, in order to place the apparatus in proper position around propeller shaft 11, as is illustrated in FIG. 1. Following the placement of the lower engaging section 44, in position adjacent shaft 11, upper portion 38 is replaced onto apparatus 10, and boltingly secured as is illustrated in FIGS. 1 and 2. It is essential that when apparatus 10 is placed onto shaft 11, that lower support post 18 has been slidably engaged around post 20, due to the fact that once apparatus 10 is in place, there may be insufficient clearance between the lower end portion of post 20 and the floor of the boat in order to slide lower post 18 into position. Therefore, lower post 18 must be previously slidably engaged onto upper post 20.

Following the positioning of apparatus 10 around propeller shaft 11, apparatus 10 is allowed to be placed in the immobilized position by hydraulically injecting fluid into hydraulic cylinders 50, and the upper and lower engaging portions moving in their respective directions for secure positioning around propeller shaft 11, as is illustrated in FIG. 4. Following this firm securing of engaging sections against propeller shaft 11, lower post 18 is slidably removed approximately ½ inch, from the apparatus, and there is placed in position U-shaped spacer 80 (as illustrated in FIG. 2), which is approximately ½ inch in thickness. Following the placement of U-shaped spacer 80 between the upper most end of support post 18 and apparatus 10, transverse beam 14 is placed in position directly in contact with floor portion 16 of base 18, and boltingly connected thereto, with transverse beam 14 being rigidly connected to the horizontal structural beams of the boat via welding or the like. Diagonal bracing may be utilized to better secure apparatus 10 in position. Following the firm securing of post 18 onto beam 14, spacer 80 is slidably removed therefrom, thereby establishing a ½ inch gap between the lower floor of apparatus 10, and the upper portion of post 18. This ½ inch space is essential, in view of the fact that at the point that hydraulic pressure is relieved for the re-mobilization of propeller shaft 11, lower most engaging section 44 will have the ability to drop approximately ½ inch away from shaft 11, while upper engaging section 38 will have the ability to rise up via the spring in hydraulic cylinders 50, thus establishing ½ inch circumferential spaces 90 as illustrated in FIG. 2 between upper and lower engaging sections 38 and 44 and propeller shaft 11.

As discussed earlier, there is further provided, on engaging sections 38 and 44, brake friction means 74 and 75 respectively, which are typical brake shoe material as found in automobiles or the like, and serve as a friction surface between engaging sections 44 and 38 and the exterior surface of propeller shaft 11, in order to establish more secure braking.

In the operation of apparatus 10, once it has been secured and placed, FIGS. 3 and 4 illustrate in side view, the relative movement of engaging sections 38 and 44 during the immobilizing process. Hydraulic fluid is injected into hydraulic cylinders 50 as is illustrated by line 84 in FIG. 4. Upper engaging section 38 is forced to move downward (arrow 85) against the pressure until brake friction means 74 makes friction contact with the upper ½ circumferential surface of propeller shaft 11. Once upper engaging section 38 is unable to move downward due to its contact with shaft 11, the lower engaging section 44, since pressure is still being applied by hydraulic fluid in cylinders 50, must move upward to counteract the hydraulic force, and likewise, lower brake lining 75 makes contact with the lower section of propeller shaft 11, thus establishing the substantial entire friction contact between brake shoes 74 and 75 and propeller shaft 11.

During this injection of hydraulic pressure, brake shoes 74 and 75 will remain in friction contact with the surface of propeller shaft 11, and propeller shaft 11 will be disallowed from rotation. As is illustrated in FIG. 1, closure valve 69 has handle 62A which, when placed in the closed position would maintain the hydraulic fluid between valve 69 and hydraulic cylinders 50 in the constant pressurized state, and therefore maintain apparatus 10 in the closed position around propeller shaft 11. Likewise in order to free propeller shaft 11, valve 62A is open, and the hydraulic pressure is therefore relieved, and lower section 44 drops back into place against the upper portion of mounting post 18, and upper section 38 is moved upward due to the expansion of springs within hydraulic cylinders 50, thus providing ½ inch clearance space 90 for clear rotation of shaft 11 during use.

In the utilization of apparatus 10, apparatus 10 is maintained at all times adjacent shaft 11, with the ½ inch of space 90 between the exterior shaft 11 and the interior surfaces of engaging means 38 and 44. There is adequate clearance so that apparatus 10 does not have to be removed. Should in fact, propeller shaft 11 have to be repaired, apparatus 10 is easily removed by the removal of bolts 28 through 31, and the subsequent removal of bolts 17 and 18 from transverse beam 14, to enable the removal of lower base post 20 of the apparatus.

In the preferred embodiment, apparatus 10 would be constructed of hard grade steel, and all essential parts would be rigidly connected via welding or the like with hydraulic lines 51 and 52, and all hydraulic couplings able to withstand substantial hydraulic pressure as is required for the various sizes of propeller shafts to be immobilized of course depending on the diameter of a particular shaft, various sizes of immobilizers may be constructed to accomodate the need.

In the preferred embodiment, if one so chooses, there may be further provided an electric switch means electrically wired to a central regulator and manifold for, when necessary, opening a valve leading to each immobilizer, for allowing hydraulic fluid to pressurize and immobilize a particular shaft. Thus, the pilot of a boat could, from the control tower, activate or deactivate an immobilizer around a shaft as need be.

In the event that the hydraulic system of the apparatus 10 fails, the system is able to be manually activated as follows. In FIG. 2, it will be noted that there are extended threads along body 46 of each bolt 28 through 31. In order to manually set the apparatus in frictional engagement with shaft 11, the head of bolts 28 through 31 are rotated by a wrench or the like, which would cause bolts 28 through 31, since they are threaded through the floor 22 of apparatus 10, would lower the upper engaging section 38 and frictional engagement with shaft 11, and likewise raise lower engaging section 44 in frictional engagement, as seen in FIG. 4. Of course, at the time one wishes to remove apparatus 10, the bolts 28 through 31 are rotated in the opposite direction, thus establishing non-engagement between shaft 11 and engaging means 38 and 44. As is apparent in FIG. 2, the extended threaded area of bolts 28 through 31, would allow the movement of engaging means 38 and 44 at least the total 1 inch distance which would be required in order to engage engaging means 38 and 44 in frictional contact with shaft 11.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A propeller shaft immobilizer apparatus comprising:

a. lower support base means, mounted perpendicularly in relation to a longitudinal axis of said shaft;

b. upper support base means slidably mounted onto said lower support base means;

c. plate base means rigidly and transversely mounted onto said upper support base means;

d. a plurality of guide means threadably attached to said plate base means and extending vertically a distance above said plate base means;

e. first lower engaging means slidably mounted on said guide means, said engaging means movable towards and away from said propeller shaft, for engaging the shaft to be immobilized;

f. second upper engaging means, cooperating with said first engaging means by slidably moving along said guide means away from and towards said shaft, said first engaging means and said second engaging means conforming substantially to the circumferential surface of said propeller shaft;

g. hydraulic means for selectively moving said first engaging means and said second engaging means in cooperation with one another, and in frictional contact with the outer surface of said shaft, in order to immobilize said shaft;

h. valving means to maintain said first and second engaging means in contact with said shaft to maintain said shaft in the state of immobilization; and i. spacer means for establishing a non-frictional relationship between said shaft and said first and second engaging means during a non-operation.

2. The apparatus in claim 1, wherein said first engaging means and said second engaging means further comprise brake surface means for making frictional contact with the outer surface of said shaft.

3. The apparatus in claim 1 further comprising a readout means for numerically determining the hydraulic pressure applied during immobilization.

4. A shaft immobilizer apparatus, comprising:

a. a vertically disposed lower support base which is a substantially hollow, open-ended rectangular steel base, said base fixedly mounted on its lower most end;

b. an upper support base portion slidably mounted on said lower base portion, and moving vertically in relation to said lower support base portion;

c. first lower engaging means, movable in relation to said upper support base for engaging the shaft to be immobilized;

d. second upper engaging means working in coperation with said first engaging means, said first and second engaging means defining an axially aligned immobilizing surface substantially conforming to the circumferential surface of said shaft during the immobilization of said shaft;

e. hydraulic power means, for moving said first and second engaging means from a substantially non-immobilization position to substantially an operative immobilization position;

f. friction means mounted on the inner surfaces of said first and second engaging means, said friction means coming into frictional contact with said shaft during the immobilization of said shaft;

g. a hydraulic fluid source;

h. pressure valve means for maintaining said hydraulic fluid under pressure in order to maintain immobilization of said shaft, and for relieving hydraulic pressure establishing non-contact between said first and second engaging means and said shaft; and i. spaced means for establishing clearance between said lower and upper engaging means and the outer surface of said shaft during non-immobilization of said shaft.

* * * * *